US006818871B2

(12) United States Patent
Ogasawara et al.

(10) Patent No.: US 6,818,871 B2
(45) Date of Patent: Nov. 16, 2004

(54) INDUCTION HEATING ROLLER UNIT, FIXING DEVICE AND IMAGE FORMING APPARATUS

(75) Inventors: Takayuki Ogasawara, Kanagawa-ken (JP); Ichiro Yokozeki, Kanagawa-ken (JP); Takaaki Tanaka, Kanagawa-ken (JP)

(73) Assignee: Harison Toshiba Lighting Corp., Imabari (JP)

( * ) Notice: Subject to any disclaimer, the term of this patent is extended or adjusted under 35 U.S.C. 154(b) by 0 days.

(21) Appl. No.: 10/421,806

(22) Filed: Apr. 24, 2003

(65) Prior Publication Data

US 2004/0004071 A1 Jan. 8, 2004

(30) Foreign Application Priority Data

Apr. 30, 2002 (JP) ..... 2002-128623

(51) Int. Cl.[7] ..... H05B 6/14; G03G 15/20

(52) U.S. Cl. ..... 219/619; 219/670; 219/674; 399/328; 399/330

(58) Field of Search ..... 219/619, 656, 219/662, 671, 672, 674, 676, 670; 399/328, 329, 330, 331, 335, 336

(56) References Cited

U.S. PATENT DOCUMENTS 6,255,632 B1 * 7/2001 Yokoyama et al. ..... 219/619
6,505,027 B2 * 1/2003 Takeuchi et al. ..... 399/328
6,573,485 B2 6/2003 Yokozeki ..... 219/619
6,670,588 B2 * 12/2003 Kitano et al. ..... 219/619
2002/0031381 A1 * 3/2002 Miyahara et al. ..... 399/330
2002/0125244 A1 9/2002 Yokozeki et al. ..... 219/619

FOREIGN PATENT DOCUMENTS

JP 2000-215971 8/2000
JP 2000-215974 8/2000

OTHER PUBLICATIONS

H. Nagosi et al. "High Frequency Induction Heating Roller", Patent Abstracts of Japan, JP59–33787, Feb. 23, 1984.

* cited by examiner

*Primary Examiner*—Philip H. Leung
(74) *Attorney, Agent, or Firm*—Finnegan, Henderson, Farabow, Garrett & Dunner, L.L.P.

(57) ABSTRACT

To provide an induction heating roller unit that can efficiently supply power to a heating roller, and fixing device and image forming apparatus incorporating the same. The induction heating roller unit includes: a heating roller; and an induction coil having an outer diameter more than 0.7 times that of the heating roller, the heating roller being concentrically disposed outside said induction coil and generating heat by the effect of an induced current caused by a magnetic field produced by the induction coil. Since the ratio of the outer diameter of the induction coil to that of the heating roller is 0.7 or higher, power can be transferred from the induction coil to the heating roller with an extremely high efficiency.

13 Claims, 5 Drawing Sheets

INDUCTION HEATING ROLLER UNIT, FIXING DEVICE AND IMAGE FORMING APPARATUS

BACKGROUND OF THE INVENTION

1. Field of the Invention

The present invention relates to an improved induction heating roller unit, and improved fixing device and image forming apparatus incorporating the same.

2. The Basic Construction of the Prior Art

Conventionally, heating rollers which incorporate a halogen lamp as a heat source have been used to thermally fix a toner image. However, heating rollers of this type are disadvantageously inefficient and need a large amount of power. Thus, in order to eliminate the disadvantage, heating rollers involving induction heating are under development.

In Japanese Patent Laid-Open No. 2000-215974, there is described an exciting coil which is disposed near a heating roller made of a magnetic material, which is a body to be heated, and causes an induced current in the heating roller, the exciting coil being formed by deforming a two-dimensionally coiled wire to fit to the curved surface of the body to be heated, and magnetic cores shaped to fit to the curved surface of the exciting coil being disposed at both longitudinal ends of the exciting coil and on the side opposite to the body to be heated (prior art 1).

Besides, in Japanese Patent Laid-Open No. 2000-215971, there is described an induction heating apparatus which comprises a heating rotator that generates heat in an electromagnetic induction manner, that is, a heating roller and magnetic flux generating means disposed inside the heating rotator, and heats a body to be heated by a high frequency induced magnetic flux generated by the magnetic flux generating means causing the heating rotator to generate heat in an electromagnetic induction manner, in which the magnetic flux generating means includes a core made of a magnetic material and an electromagnetic conversion coil wound around the core, and the magnetic material core has a core section around which the electromagnetic coil is wound and magnetic flux guiding core sections for concentrating the magnetic flux from the core section to one region of the heating rotator that are disposed opposite to each other with a magnetic space gap interposed between tips thereof (prior art 2).

The prior arts 1 and 2 are both based on a heating scheme involving an eddy current loss (referred to as "eddy current loss scheme"; hereinafter), which is adopted in IH rice cookers having been commercially practical. Here, the frequency of the high frequency wave in the eddy current loss scheme approximately ranges from 20 to 100 kHz.

On the other hand, In Japanese Patent Laid-Open No. 59-33787, there is described a high frequency induction heating roller comprising a cylindrical roller body made of a conductive material, that is, a heating roller, a cylindrical bobbin disposed in the roller body concentrically, and an induction coil wound around the bobbin in a spiral manner which causes an induced current in the roller body for heating when it is energized (prior art 3).

In the prior art 3, the cylindrical roller body serves as a secondary coil of a closed circuit, and the induction coil serves as a primary coil, whereby a transformer coupling occurs between them to induce a secondary voltage in the secondary coil, that is, the cylindrical roller body. Then, the secondary voltage produces a secondary current flowing through the closed circuit of the secondary coil, whereby the cylindrical roller body generates heat. Thus, the prior art 3 adopts a heating scheme based on heat generation on the secondary side (referred to as "transformer scheme", hereinafter). The transformer scheme has advantages in that the fixing device has a simple structure compared to the prior arts 1 and 2, because it is higher in efficiency due to its stronger magnetic coupling than the eddy current loss scheme and it can heat the entire heating roller. In addition, if the operating frequency thereof is set at 100 kHz or higher, more preferably, at 1 MHz or higher, the quality factor Q can be increased to provide a high power transfer efficiency. Thus, the total efficiency of heating can be increased, so that power saving can be achieved. Furthermore, the transformer scheme has an advantage in that the fixing device has a simple structure compared to that for the eddy current loss scheme. Furthermore, the heat capacity can be significantly reduced compared to the heating roller for the eddy current loss scheme. Therefore, the transformer scheme is highly suitable for speedup of thermal fixing.

The inventors have already devised a transformer coupling type in which a hollow heating roller coreless-transformer-coupled with an induction coil and rotatably supported thereon has a secondary coil formed into a closed circuit in which the secondary-side resistance is approximately equal to the secondary reactance, whereby the efficiency of power transfer from the induction coil to the heating roller is increased and thus, the heating roller can be efficiently heated. This invention is Japanese Patent Application No. 2001-016335. This invention has facilitated power saving in induction heating of the heating roller and speedup of thermal fixing.

Disadvantage of Prior Art

Furthermore, the inventors have conducted researches on the appropriate distance between the heating roller and the induction coil disposed in the heating roller. As a result, the inventors have found that the efficiency of transfer of high frequency power from the induction coil to the heating roller is closely related to the distance between the heating roller and the induction coil, and in particular, if the distance is equal to or longer than a predetermined value, a high transfer efficiency of high frequency power can be achieved. This finding has lead to the present invention.

SUMMARY OF THE INVENTION

Object of the Invention

An object of the present invention is to provide an induction heating device arranged to transfer a high frequency power from an induction coil to a heating roller with a high efficiency, and fixing device and image forming apparatus incorporating the same.

Characterized Construction of the Invention

An induction heating roller unit according to the invention is characterized in that it comprises an induction coil that has an outer diameter more than 0.7 times that of a heating roller, is disposed inside the heating roller, produces a magnetic field and induces a current in the heating roller to cause the heating roller to generate heat, the current being induced by interlinkage of the magnetic field and the heating roller.

Here, "the induction coil has an outer diameter more than 0.7 times that of the heating roller" means that the outer diameter of the finished induction coil is 70% or more of the outer diameter of a main heat generating part of the heating roller, that is, a part serving as a secondary coil. As the outer diameter of the induction coil becomes closer to that of the heating roller, the magnetic coupling between the induction coil and the heating roller becomes stronger, and therefore, high frequency electrical energy becomes transferred from the induction coil to the heating roller with a higher efficiency. Surprisingly, researches by the inventors have proved that the power transfer efficiency is significantly changed at the outer diameter ratio of 70%. Specifically, if the outer diameter ratio is less than 70%, the efficiency of high frequency electrical power transfer from the induction coil to the heating roller is extremely reduced. To the contrary, according to the invention, since the outer diameter ratio is set to 70% or higher, the efficiency of high frequency electrical power transfer from the induction coil to the heating roller is significantly increased. Within the range of the outer diameter ratio of 70% or higher, the transfer efficiency of high frequency electrical energy increases little by little, while being kept at a high value.

Preferably, the outer diameter of the heating roller which can be practically accommodated in a fixing device in an image forming apparatus is selected from a range from 20 mm to 60 mm. Firstly, this is because a relatively high transfer efficiency of high frequency power can be achieved when an adequate clearance required for rotation is provided between the induction coil and the heating roller. Secondly, this is because a fixing device having a size suitable for the image forming apparatus can be provided. More preferably, the outer diameter of the heating roller is selected from a range from 30 mm to 40 mm.

The heating roller is disposed substantially concentrically outside the induction coil. The phrase "substantially concentrically outside" means that the induction coil is disposed in an interior space of the heating roller and does not necessarily means that the axes of the induction coil and the heating roller have to coincide with each other. However, the two are preferably substantially concentric with each other. This is because, if the heating roller and the induction coil are concentric with each other, the temperature rise distribution on the heating roller is uniform around the axis of the heating roller. However, even if the two are not perfectly concentric with each other, when they are substantially concentric with each other, substantially the same effect can be achieved.

According to the invention, the magnetic coupling between the heating roller and the induction coil is not limited to a specific scheme. However, coreless transformer coupling is preferably used.

Function of the Invention

Advantage of the Invention

According to the invention, since the heating roller and the induction coil are arranged as described above, the efficiency of high frequency electrical power transfer from the induction coil to the heating roller is significantly increased. Thus, a highly efficient induction heating roller unit can be provided. In addition, since the heating roller is heated via induction heating, a quick temperature rise can be attained, and thus, the time required to increase the temperature of the heating roller to a required level after switch-on can be shortened.

Other features of the present invention will be described.

<Heating roller>

The heating roller is adapted to cause an induced current therein when it is magnetically coupled with the induction coil. The heating roller has a secondary coil of a closed circuit, and when it is magnetically coupled with the induction coil, a secondary current is induced in the secondary coil mainly in a circumferential direction. The secondary coil is wound around a rotation axis of the heating roller and may be of one or more turns. In addition, a high power transfer efficiency is achieved when the secondary-side resistance value of the secondary coil is substantially equal to the secondary reactance.

Here, "the secondary-side resistance value is substantially equal to the secondary reactance" means that the following condition expressed by the formula 1 is satisfied, where Ra is the secondary-side resistance value, Xa is the secondary reactance and $\alpha$=Ra/Xa.

$$0.25<\alpha<4 \qquad \text{formula 1}$$

Here, the secondary-side resistance value can be determined by measurement, and the secondary reactance can be determined by calculation.

Furthermore, the heating roller may have one or more secondary coils. If the heating roller has one secondary coil, the secondary coil desirably extends along almost whole of the effective axial length of the heating roller. If the heating roller has a plurality of secondary coils, the secondary coils are desirably disposed spaced apart from each other along the axis of the heating roller.

Now, an exemplary structure of the heating roller suitable for coreless transformer coupling (transformer coupling heating scheme) will be described. In this example, the heating roller comprises a roller base, a first metal coating and a second metal coating.

The roller base is made of a metal or heat-resistant insulator. In the case of a metal, any metal may be used as far as it is heat resistant and has high mechanical strength, regardless of whether it is conductive or not. However, in terms of machinability, cost or the like, Fe and Al are preferably used on the other hand, in the case of a heat-resistant insulator, any insulator may be used as far as it is heat resistant and has high mechanical strength. However, ceramics and glass are preferably used.

The first metal coating is disposed on the surface of the roller base. It constitutes the secondary coil of a closed circuit, which is coreless-transformer-coupled with the primary coil (induction coil).

In order to provide a desired secondary-side resistance value, the first metal coating may be made of any the materials listed below in any of the manufacturing methods described below. If the first metal coating is formed by electroplating, vapor deposition or sputtering, it is preferably made of a metal selected among from Cu, Ni, Ag and Al or an alloy thereof. On the other hand, if the first metal coating is formed by a thick film forming method (including application and firing), it is preferably made of Cu, Ag or Ag+Pd.

The second metal coating is made of an oxidation-resistant metal and covers the surface of the first metal coating. That is, the second metal coating protects the surface of the first metal coating to prevent the same from being oxidized. The surface of the second metal coating may be oxidized. The second metal coating may be made of a metal selected among from Zn, Sn, Ni and Ti or an alloy thereof, and formed by electroplating, vapor deposition, sputtering or a thick film forming method.

The first and second metal coatings may be disposed on either one or both of the outer and inner surfaces of the roller base. Furthermore, the first and second metal coatings may be multilayered.

Furthermore, in order to provide a more practical heating roller, the following components may be additionally provided as required.

1. Protective Layer

As required, a protective layer may be provided for mechanical protection and electrical insulation of the heating roller or for enhancing elastic contact or toner releasability. As a material of the protective layer for the former purpose, glass can be used. As a material of the protective layer for the latter purpose, a synthetic resin can be used.

2. Configuration of the Heating Roller

As required, a crown may be formed on the heating roller. The crown may be in the shape of a drum or barrel.

3. Rotary Mechanism for the Heating Roller

A conventional mechanism for rotating the heating roller can be appropriately adopted.

4. Temperature Sensor

In order to control the temperature of the heating roller, a temperature sensor may be in contact with the heating roller at an appropriate point in a heat conductive manner. When a plurality of induction coils are disposed spaced apart from each other along the axis of the heating roller, a plurality of temperature sensors can be disposed to be sensitive to heat at positions corresponding to the respective induction coils. Then, controlling the power applied to the induction coils based on the temperatures at the axial positions can improve uniformity of temperature of the heating roller.

<Induction Coil>

The induction coil is means for transferring a high frequency alternating-current power to the heating roller by being magnetically coupled, in particular, transformer-coupled with the heating roller. The induction coil is disposed so as to produce a magnetic flux in the axial direction of the heating roller, whereby the induction coil is transformer-coupled with the heating roller. However, the induction coil and the heating roller do not necessarily need to be concentric. If the induction coil is disposed inside the heating roller, magnetic coupling (transformer coupling) between them is facilitated.

The induction coil produces a magnetic field when it is excited by a high frequency alternating-current power supply, and interlinkage of the magnetic field and the heating roller causes a high frequency induced current in the heating roller. That is, the induction coil and the heating roller are magnetically coupled (transformer-coupled) with each other via the high frequency alternating-current power supply. Thus, the induction coil and the heating roller serve as a primary coil and a secondary coil, respectively, of a transformer.

One or more induction coils may be provided. If a plurality of induction coils are used, the plurality of induction coils can be connected to a single high frequency alternating-current power supply in parallel or in series. On the other hand, if a plurality of induction coils are connected to their respective high frequency alternating-current power supplies, input power to the induction coils can be adjusted on an individual basis or on a group basis. Furthermore, if a plurality of induction coils are used, they are preferably disposed spaced apart from each other in the axial direction of the heating roller. In this case, adjacent induction coils may be disposed at an adequate distance from each other or may overlap with each other if there is no problem about insulation.

Furthermore, as required, the induction coil may incorporate a component which serves as a core. When the induction coil is to be coreless-transformer-coupled with the heating roller, the induction coil is configured without any core. Here, the term "coreless transformer coupling" means not only coreless transformer coupling in its literal sense, but also transformer coupling that can substantially be regarded as being coreless. For example, an induction coil having no magnetic material therein may be used.

The induction coil may be static or may be rotated together with or independently of the rotating heating roller. If it is rotated, a rotatable current collecting mechanism may be provided between the high frequency alternating-current power supply and the induction coil.

Variation of the Invention

The following components, which are not essential in the invention, may be additionally provided as required.

1. (Concerning High Frequency Alternating-Current Power Supply)

The high frequency alternating-current power supply is means for energizing the induction coil by applying a high frequency alternating-current voltage to the induction coil. The frequency of the output power of the high frequency alternating-current power supply is not essentially limited to a specific value. However, in the case of a transformer coupling heating scheme using coreless transformer coupling, a high frequency power at 100 kHz or higher is conveniently output. This is because a high frequency power at 100 kHz or higher can increase the quality factor Q of the induction coil, thereby providing a higher power transfer efficiency. A higher power transfer efficiency leads to a higher total efficiency of heating, and thus, power saving can be achieved. Here, a high frequency power at 1 to 4 MHz is preferable in terms of cost efficiency and facility of high frequency noise suppression for a suitable active device (for example, a MOSFET may be used, as described later).

Furthermore, in order to generate an alternating current at a desired frequency, practically, a direct current or a low frequency alternating current is directly or indirectly converted into an alternating current by means of an active device, such as a semiconductor switch device. When producing a high frequency alternating-current power at a desired frequency from a low frequency alternating current, rectifier means is preferably used to convert the low frequency alternating current into a direct current. The direct current may be a smoothed direct current provided through a smoothing circuit or may be a non-smooth direct current. In order to convert the direct current into a high frequency alternating current, a circuit element, such as an amplifier and an inverter, can be used. As an amplifier, a class E amplifier, which is high in power conversion efficiency, can be used, for example. Besides, a half bridge type inverter can be used. Furthermore, as an active device, a MOSFET, which is superior in frequency characteristic, is preferably used. It may be provided that a plurality of high frequency alternating-current power supply circuits are connected in parallel, the alternating-current powers from the high frequency alternating-current power supply circuits are synthesized, and then the synthesized power is applied to the induction coil. In this case, a desired power can be produced with the power of each high frequency alternating-current power supply circuit being kept low, the high frequency alternating current can be produced using a MOSFET as the active device efficiently with low cost.

Furthermore, if a plurality of induction coils are used, a single high frequency alternating-current power supply may be commonly provided for the induction coils. In this case, if the frequency of the output power of the high frequency alternating-current power supply is variable, the high frequency powers input to the respective induction coils can be controlled individually. However, essentially, a high frequency alternating-current power supply of variable frequency type can be provided for each of the induction coils.

Furthermore, essentially, the high frequency power applied to the induction coil when starting may be set higher than that during normal operation to achieve rapid heating.

Favorable Embodiment of the Invention

According to a first preferred implementation of the invention, the heating roller of the induction heating roller has an outer diameter ranging from 20 mm to 60 mm. In consideration of a required difference of about 2 mm between the inner diameter of the heating roller and the outer diameter of the induction coil, the above-described range can provide a relatively high power transfer efficiency.

Thus, if the outer diameter of the heating roller falls within the above-described range, fixing or the like of a toner image to a recording medium on which the image is formed can be efficiently carried out.

According to a second preferred implementation of the invention, the heating roller of the induction heating roller unit has an outer diameter ranging from 30 mm to 40 mm. According to this second implementation, a still higher power transfer efficiency can be achieved.

According to a third preferred implementation of the invention, in the induction heating roller unit, the heating roller has a secondary coil wound around a rotation axis thereof, and a plurality of induction coils are wound around the rotation axis of the heating roller and disposed spaced apart from each other along the rotation axis. This third implementation is suitable for induction-heating the heating roller via magnetic coupling in the coreless transformer coupling manner. Here, for a simplified configuration of the secondary coil of the heating roller, the secondary coil is composed of one turn.

According to a fourth preferred implementation of the invention, in the induction heating roller unit, there is a small clearance between the inner surface of the heating roller and the outer surface of the induction coil. When the heating roller is rotated around the induction coil while keeping the induction coil static, the clearance allows the heating roller to be rotated smoothly. The small clearance is about 2 mm.

According to a fifth preferred implementation of the invention, in the induction heating roller unit, the heating roller generates heat by the effect of coreless transformer coupling with the induction coil.

According to a sixth preferred implementation of the invention, the induction heating roller unit further comprises a high frequency alternating-current power supply for applying a high frequency alternating-current voltage to the induction coil.

When the high frequency alternating-current power supply provides an alternating current to the induction coil, the induction coil produces an alternating-current magnetic field. The magnetic field causes an induced current in the heating roller, and the induced current causes the heating roller to generate heat.

According to a seventh preferred implementation of the invention, an induction heating roller unit is characterized in that it comprises: a hollow heating roller having a secondary coil wound around a rotation axis thereof; and a plurality of induction coils which are wound around the rotation axis of the heating roller and disposed inside the heating roller spaced apart from each other along the rotation axis, have an outer diameter more than 0.7 times that of the heating roller, produce a magnetic field and induce a current in a secondary conductor of the heating roller to cause the heating roller to generate heat, the current being induced by interlinkage of the magnetic field and the secondary conductor.

According to an eighth preferred implementation of the invention, in the induction heating roller unit according to the seventh implementation, the outer diameter of the heating roller is 20 to 60 mm.

According to a ninth preferred implementation of the invention, in the induction heating roller unit according to the seventh implementation, the outer diameter of the heating roller is 30 to 40 mm.

According to a tenth preferred implementation of the invention, in the induction heating roller unit according to the seventh implementation, there is a small clearance between the inner surface of the heating roller and the outer surfaces of the induction coils.

According to an eleventh preferred implementation of the invention, in the induction heating roller unit according to the seventh implementation, the heating roller generates heat by the effect of coreless transformer coupling with the induction coils.

According to a twelfth preferred implementation of the invention, in the induction heating roller unit according to the seventh implementation, the induction heating roller unit further comprises a high frequency alternating-current power supply for applying a high frequency alternating-current voltage to the induction coils.

A fixing device according to the invention is characterized in that it comprises: an induction heating roller unit according to claim 1 or 7; and a pressure roller disposed opposite to a heating roller of the induction heating roller unit.

The term "fixing device" means a device that fixes a toner image formed on a recording medium to the recording medium by making the toner molten by heating using a heating roller and solidifying the molten toner.

The recording medium having the toner image formed thereon is passed between the heating roller and the pressure roller, whereby the toner can be heated to be molten and fixed to the recording medium. If the heating roller unit used has a high power transfer efficiency, a fixing device can be provided which can utilize energy efficiently.

An image forming apparatus according to the invention is characterized in that it comprises: an image forming apparatus main body; and a fixing device according to claim 12 disposed in the image forming apparatus main body.

According to the invention, an image forming apparatus can be provided which can utilize energy efficiently.

Toner image forming means is to form a toner image on a recording medium in an indirect or direct manner. Here, the term "indirect manner" means a scheme in which an image is formed by transferring.

The image forming apparatus include an electrophotographic copier, a printer and facsimile machine.

The recording media include a transfer sheet, printing paper, Electrofax sheet, and an electrostatic recording sheet.

DETAILED DESCRIPTION OF THE PREFERRED EMBODIMENTS

Now, embodiments of the invention will be described with reference to the drawings.

(First Embodiment of Induction Heating Roller Unit)

Figure 1B:
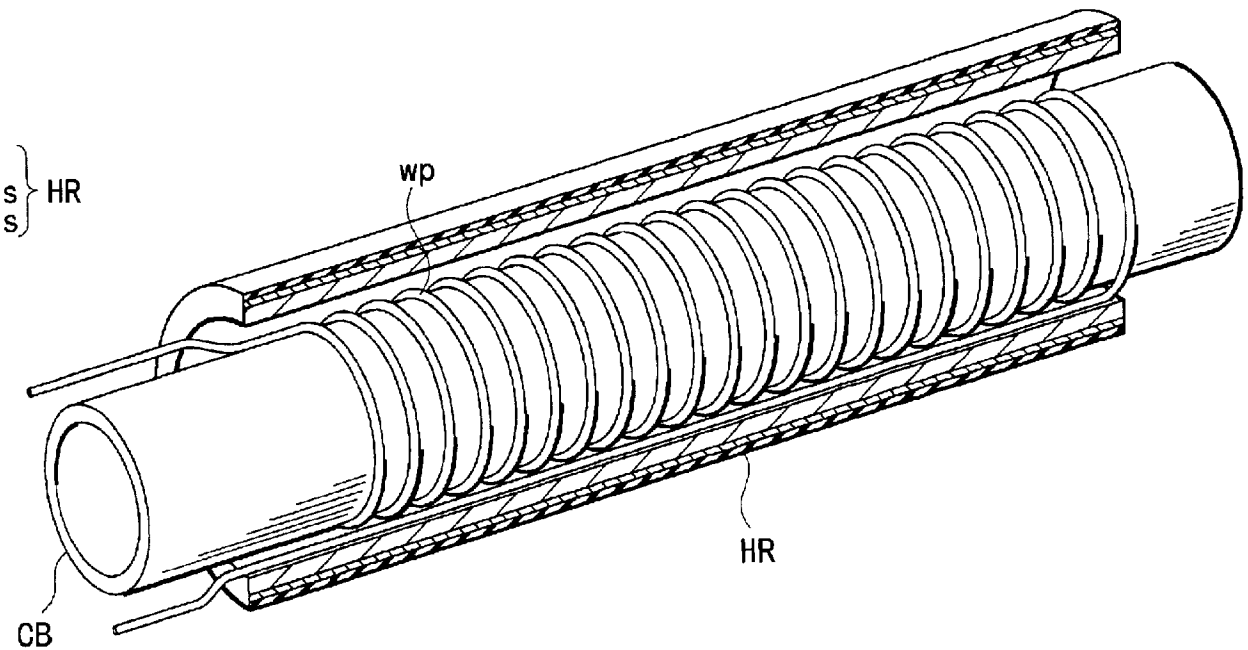
FIG. 1(B) is a side view of the induction heating roller unit according to the first embodiment of the invention.
Figure 1A:
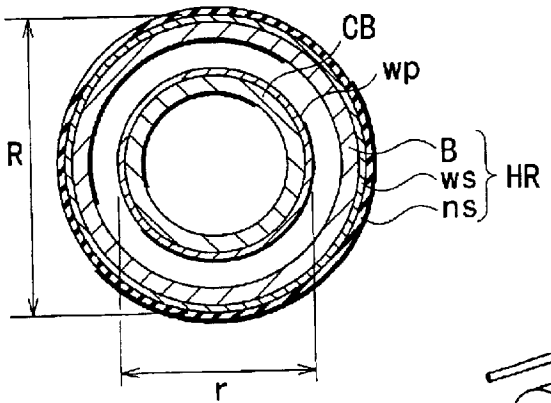
FIG. 1(A) is a perspective view of an induction heating roller unit according to a first embodiment of the invention.

FIGS. 1(A) and 1(B) are perspective and side views, respectively, showing an induction coil wp and a heating roller HR of an induction heating roller unit 10 according to a first embodiment of the invention.

The induction coil wp is composed of a conductor with a coating of insulation and wound around a bobbin made of an insulating material. Reference character r denotes an outer diameter (diameter) of the induction coil wp.

The heating roller HR comprises a roller base B, a first metal coating ws and a second metal coating ns.

The roller base B is a cylindrical body made of cast iron and has an outer diameter of 30 mm, a thickness of 1 mm and a length of 300 mm, for example.

The first metal coating ws constitutes a secondary coil of one turn composed of a cylindrical Cu film having a thickness of several tens $\mu$m formed by metal plating. The first metal coating ws is disposed on an outer surface of the roller base B along almost whole of the effective longitudinal length thereof. The thickness of the first metal coating ws is determined so as to provide a circumferential secondary-side resistance of the heating roller HR equal to 1Ω, which is nearly equal to the secondary reactance thereof. A secondary current caused by a magnetism from the induction coil wp flows through the first metal coating ws in a circumferential direction, and thus, the first metal coating ws generates heat to increase the temperature of itself.

The second metal coating ns is composed of a Zn film having a thickness of several tens $\mu$m and formed by electroplating, and covers the entire surface of the first metal coating ws. The secondary-side resistance values of the roller base B and the second metal coating ns are set to values significantly different from the secondary reactance.

Here, reference character R denotes an outer diameter (diameter) of the heating roller HR. The thicknesses of the first metal coating ws and the second metal coating ns are negligible substantially.

A bearing mechanism for rotating the induction heating roller unit can be known one, so that it not shown.

Figure 2:
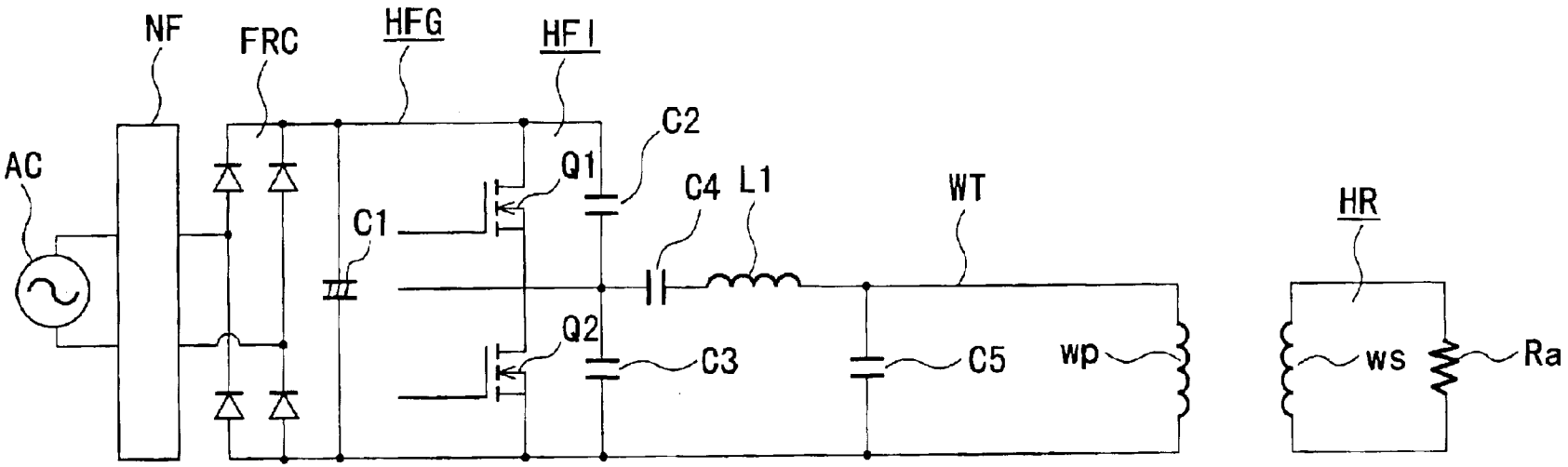
FIG. 2 is a circuit diagram of the induction heating roller unit according to the first embodiment of the invention.

FIG. 2 is a circuit diagram of the induction heating roller unit according to the first embodiment of the invention.

In this drawing, an abbreviation AC denotes a low frequency alternating-current power supply, an abbreviation HFG denotes a high frequency alternating-current power supply, an abbreviation wp denotes the induction coil and an abbreviation HR denotes the heating roller.

The low frequency alternating-current power supply AC is 100-V utility power.

The high frequency alternating-current power supply HFG comprises a noise filter NF, a full wave rectifier circuit FRC, a smoothing capacitor C1 and a half-bridge type high frequency inverter HFI.

The noise filter NF absorbs a high frequency noise caused by switching of the high frequency inverter HFI, thereby preventing the noise from being transmitted to the low frequency alternating-current power supply AC.

The full wave rectifier circuit FRC rectifies a low frequency alternating current to output a pulsed direct current.

The smoothing capacitor C1 converts the pulsed direct current to a smooth direct current.

The half-bridge type high frequency inverter HFI comprises a pair of switching means Q1 and Q2, a pair of capacitors C2 and C3, and an inductor L1 and a capacitor C4 that constitute a series resonant circuit. The switching means Q1 and Q2 of the pair are MOSFETs and connected in series between both ends of the smoothing capacitor C1. The pair of capacitors C2 and C3 is connected in parallel with the switching means Q1 and Q2. The inductor Li and the capacitor C4 are connected in series, together with a load, between both ends of the switching means Q2 to constitute the series resonant circuit.

The induction coil wp is connected in parallel with a capacitor C5 between paired wirings WT.

The heating roller HR has a secondary-side resistor Ra which is equivalent to the secondary coil ws.

In the high frequency inverter HFI, a high frequency alternating-current power at 2.6 MHz appears across the switching means Q2, and the series resonant circuit composed of the inductor L1 and the capacitor C4 provides a sinusoidal high frequency alternating-current voltage at 2.6 MHz and applies the same to the induction coil wp. Since the capacitor C5 is connected in parallel with the induction coil wp, the power factor is improved.

(Second Embodiment of Induction Heating Roller Unit)

Figure 3:
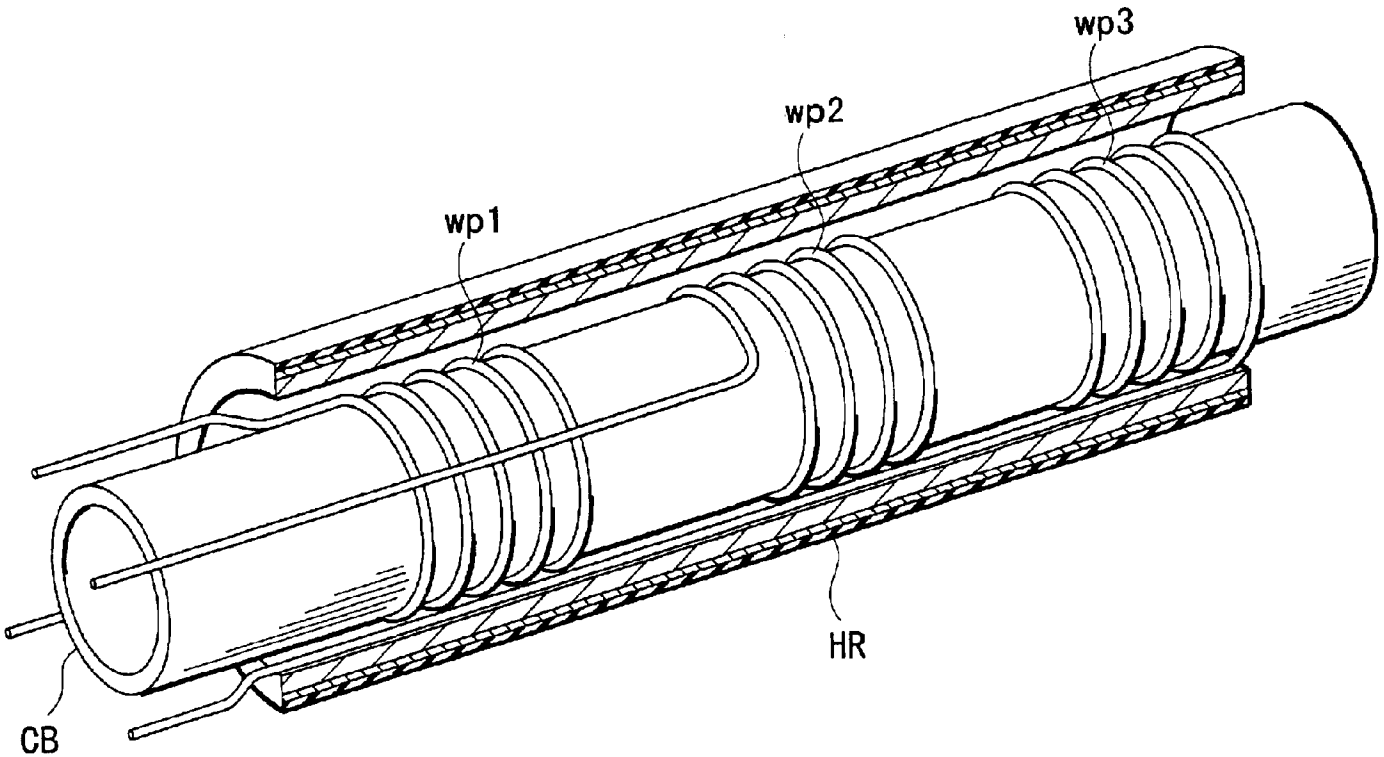
FIG. 3 is a perspective view of an induction heating roller unit according to a second embodiment of the invention.

FIG. 3 is a perspective view of an induction heating roller unit according to a second embodiment of the invention.

In this embodiment, there are provided a plurality of induction coils wp1 to wp3 on a bobbin CB made of an insulating material. The induction coils wp1 to wp3 are supplied with power in parallel from a power supply.

The remainder is substantially the same as in the first embodiment, and thus, description thereof is omitted.

(Result of Experiment)

Figure 4:
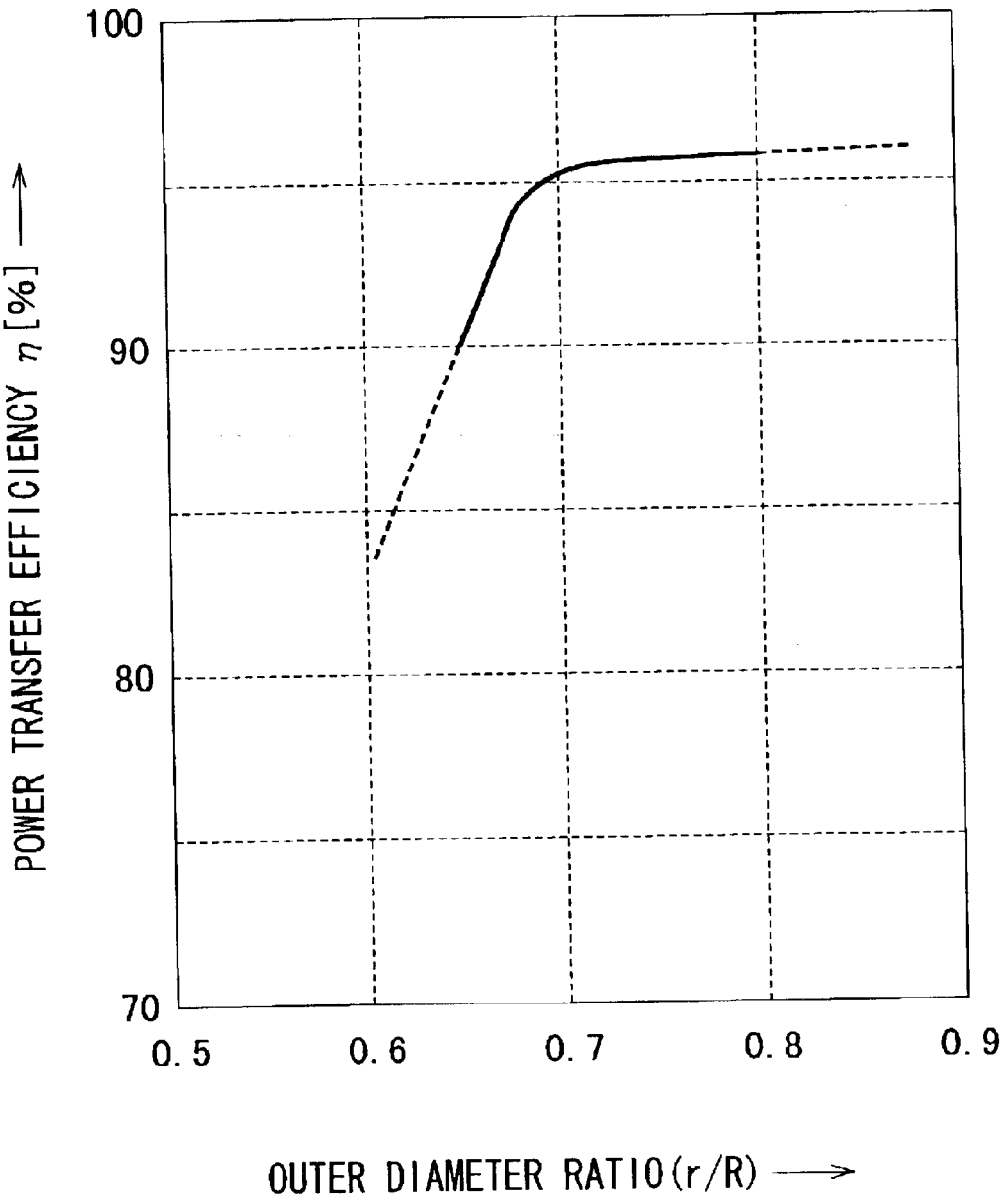
FIG. 4 is a graph showing a relation between a power transfer efficiency and a ratio between outer diameters of a heating roller and an induction coil in the induction heating roller unit according to the invention.

FIG. 4 is a graph showing a relation between a power transfer efficiency η and a ratio (outer diameter ratio: r/R) between the outer diameter r of the induction coil wp and the outer diameter R of the heating roller HR in the induction heating roller unit 10 according to the invention.

The power transfer efficiency η indicates a ratio between a power externally supplied for heating of the heating roller HR (a power supplied to the induction coil wp, herein) and a power received by the heating roller HR (a power consumed for heat generation of the heating roller, herein).

Within a range of the outer diameter ratio lower than about 0.7, the power transfer efficiency η increases with the outer diameter ratio, and within a range of the outer diameter ratio equal to or higher than about 0.7, the power transfer efficiency η is nearly constant, at about 95%. In other words, if expressing the outer diameter ratio as R/r, R being the outer diameter of the first metal coating ws, it is proved that a value of about 1.43 is a threshold of the outer diameter ratio.

In general, the heat radiation scheme using a halogen lamp provides a power transfer efficiency of about 70%, and the eddy current loss scheme provides a power transfer efficiency of about 85%. It is proved that, compared to these and other schemes, the transformer coupling schemes used in the embodiments of the invention is superior.

(Fixing Device)

Figure 5:
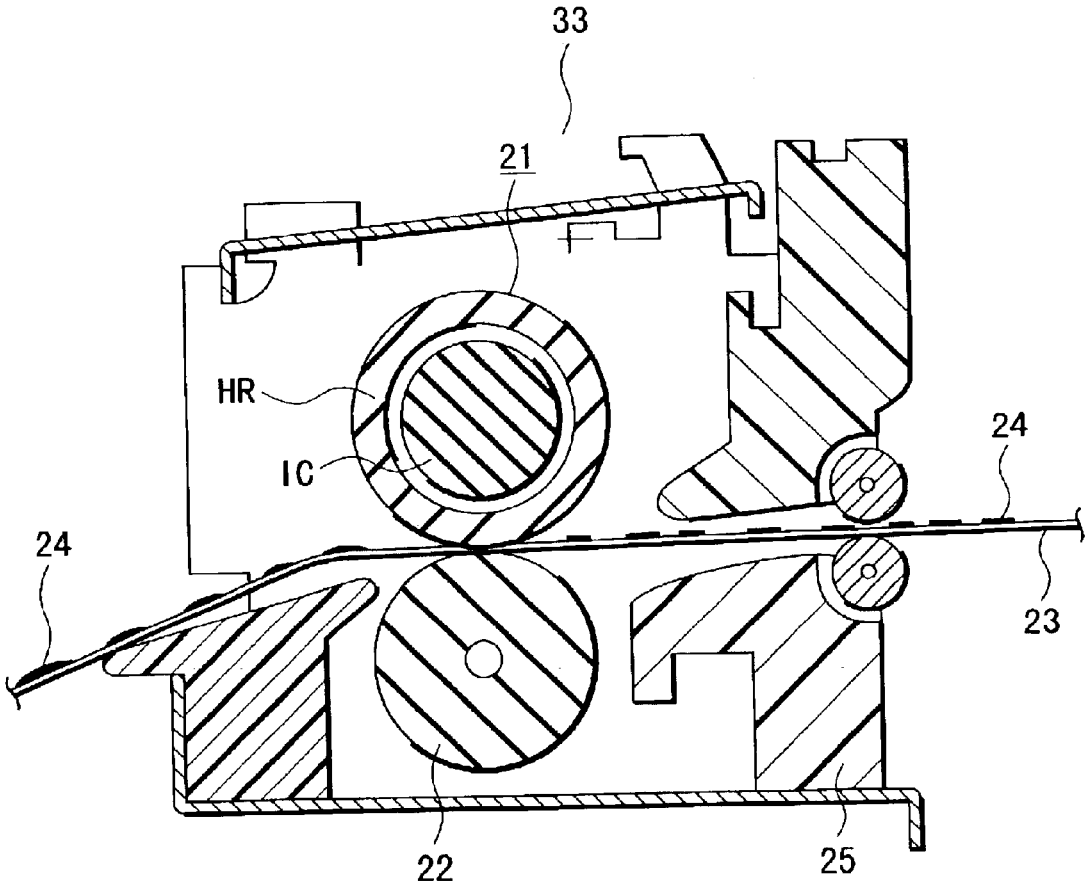
FIG. 5 is a vertical cross-sectional view of a fixing device according to the invention.

FIG. 5 is a vertical cross-sectional view of a fixing device according to an embodiment of the invention.

In this drawing, reference numeral 21 denotes an induction heating roller unit, reference numeral 22 denotes a pressure roller, reference numeral 23 denotes a recording medium, reference numeral 24 denotes a toner, and reference numeral 25 denotes a frame. The same parts as in FIG. 1 are assigned the same reference numerals.

The induction heating roller unit 21 may be one according to any of the embodiments described above.

The pressure roller 22 is disposed to be pressed against the heating roller HR of the induction heating roller unit 21, and the recording medium 23 is transported by being held between them with pressure.

The toner 24 is deposited onto the surface of the recording medium 23 to form an image.

These components except for the recording medium 23 are mounted on the frame 25 in a predetermined positional relationship.

In the fixing device, the recording medium 23 on which the toner 24 is deposited to form an image is inserted between the heating roller HR of the induction heating roller unit 21 and the pressure roller 22 during transportation, and the toner 24 is heated by the heating roller HR and molten, and thus, thermally fixed to the recording medium.

(Image Forming Apparatus)

Figure 6:
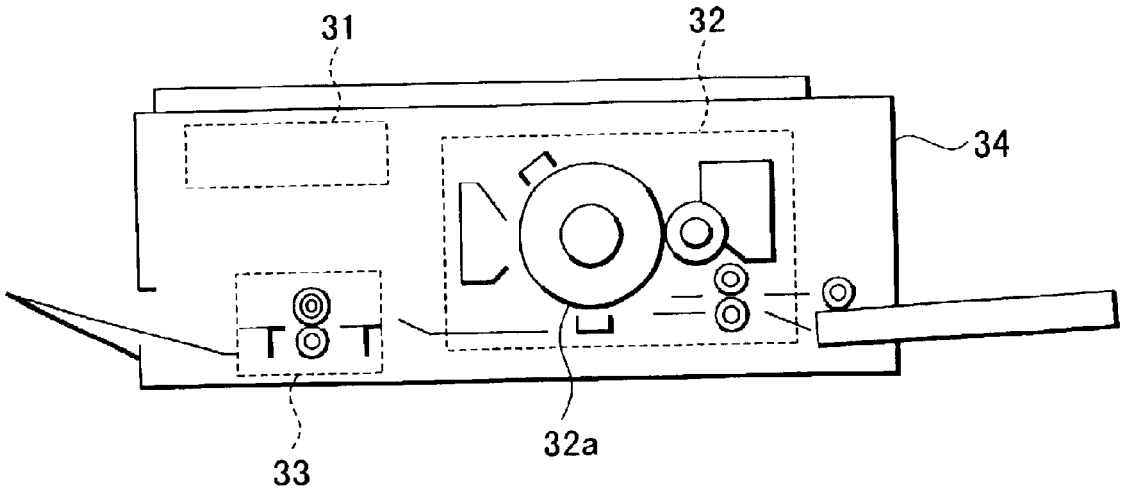
FIG. 6 is a schematic cross-sectional view of a copier, which is an embodiment of an image forming apparatus according to the invention.

FIG. 6 is a schematic cross-sectional view of a copier, which is one embodiment of an image forming apparatus according to the invention.

In this drawing, reference numeral 31 denotes a reader device, reference numeral 32 denotes image forming means, reference numeral 33 denotes a fixing device, and reference numeral 34 denotes image forming apparatus case.

The reader device 31 optically reads an image on an original and produces an image signal.

The image forming means 32 forms an electrostatic latent image on a photosensitive drum 32*a* in accordance with the image signal, deposits the toner on the electrostatic latent image to form a reverse image and transfers the reverse image to the recording medium, thereby forming an intended image on the recording medium.

The fixing device 33, which is constructed as shown in FIG. 5, heats the toner on the recording medium to make the toner be molten, thereby thermally fixing the toner to the recording medium.

The image forming apparatus case 34 houses the above-described devices and means and is additionally provided with a carrier unit, a power supply unit, a control unit or the like.

What is claimed is:

1. An induction heating roller unit, comprising:

a hollow heating roller having a secondary coil as a closed circuit wound around a rotation axis of the heating roller; and an induction coil that has an outer diameter more than 0.7 times that of the heating roller, is disposed inside a hollow portion of the heating roller so as to make a coreless transformer coupling with the heating roller, to produce a magnetic field and to induce a secondary current in the secondary coil of the heating roller, so that the secondary current flows mainly in a circumferential direction of the heating roller to generate heat, the secondary current being induced by interlinkage of the magnetic flux and the secondary coil of the heating roller.

2. The induction heating roller unit according to claim 1, wherein the outer diameter of the heating roller is 20 to 60 mm.

3. The induction heating roller unit according to claim 1, wherein the outer diameter of the heating roller is 30 to 40 mm.

4. The induction heating roller unit according to claim 1, wherein the secondary coil of the heating roller is composed of a single turn coil wound around the rotation axis, and wherein the induction coil comprises a plurality of induction coils wound around the rotation axis of the heating roller and disposed spaced apart from each other along the rotation axis.

5. The induction heating roller unit according to claim 1, wherein there is a small clearance between an inner surface of the heating roller and an outer surface of the induction coil.

6. The induction heating roller unit according to claim 1, wherein the induction heating roller unit further comprises a high frequency alternating-current power supply for applying a high frequency alternating-current voltage to the induction coil.

7. An induction heating roller unit, comprising:

a hollow heating roller having a secondary coil wound around a rotation axis thereof; and a plurality of induction coils wound around the rotation axis of the heating roller and disposed inside the heating roller spaced apart from each other along the rotation axis, have an outer diameter more than 0.7 times that of the heating roller, are disposed inside the heating roller so as to make a coreless transformer coupling with the heating roller, produce a magnetic flux and induce a secondary current in a secondary coil of the heating roller, so that the secondary current flows mainly in a circumferential direction of the heating roller to generate heat, the secondary current being induced by interlinkage of the magnetic field and the secondary coil of the heating roller.

8. The induction heating roller unit according to claim 7, wherein the outer diameter of the heating roller is 20 to 60 mm.

9. The induction heating roller unit according to claim 7, wherein the outer diameter of the heating roller is 30 to 40 mm.

10. The induction heating roller unit according to claim 7, wherein there is a small clearance between an inner surface of the heating roller and outer surfaces of the induction coils.

11. The induction heating roller unit according to claim 7, wherein the induction heating roller unit further comprises a high frequency alternating-current power supply for applying a high frequency alternating-current voltage to the induction coils.

12. A fixing device, comprising:

an induction heating roller unit according to claim 1 or 7; and a pressure roller disposed opposite to a heating roller of said induction heating roller unit.

13. An image forming apparatus, comprising:

an image forming apparatus main body; and a fixing device according to claim 12 disposed in the image forming apparatus main body.

* * * * *